US007011541B2

(12) United States Patent
Matsunaga et al.

(10) Patent No.: US 7,011,541 B2
(45) Date of Patent: Mar. 14, 2006

(54) CONNECTOR

(75) Inventors: Hideki Matsunaga, Yokkaichi (JP); Kenji Okamura, Yokkaichi (JP); Hiroshi Nakano, Yokkaichi (JP); Eiji Kojima, Yokkaichi (JP); Masaaki Tabata, Yokkaichi (JP); Tetsuya Aihara, Yokkaichi (JP); Hiroyoshi Maesoba, Yokkaichi (JP); Toshifumi Ichio, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/019,898

(22) Filed: Dec. 22, 2004

(65) Prior Publication Data

US 2005/0136725 A1 Jun. 23, 2005

(30) Foreign Application Priority Data

Dec. 22, 2003 (JP) ..... 2003-425649

(51) Int. Cl.
*H01R 13/627* (2006.01)

(52) U.S. Cl. ..... 439/354

(58) Field of Classification Search ..... 439/354, 439/355, 350, 358, 353, 595
See application file for complete search history.

(56) References Cited

U.S. PATENT DOCUMENTS

| | | | | | |
|---|---|---|---|---|---|
| 4,871,325 | A | * | 10/1989 | Maejima et al. | 439/353 |
| 4,986,766 | A | | 1/1991 | Leonard et al. | |
| 5,830,001 | A | | 11/1998 | Kinoshita et al. | |
| 5,830,013 | A | * | 11/1998 | Saito et al. | 439/595 |
| 5,910,027 | A | | 6/1999 | Wayt et al. | |
| 6,179,643 | B1 | * | 1/2001 | Fukuda | 439/358 |
| 6,383,011 | B1 | * | 5/2002 | Chen | 439/358 |
| 2002/0072265 | A1 | | 6/2002 | Chen | |

FOREIGN PATENT DOCUMENTS

| | | |
|---|---|---|
| JP | 55-49433 | 3/1980 |
| JP | 7-282883 | 10/1995 |

* cited by examiner

*Primary Examiner*—Phuong KT Dinh
(74) *Attorney, Agent, or Firm*—Gerald E. Hespos; Anthony J. Casella

(57) ABSTRACT

A female housing (20) is provided with a lock arm (30) for holding a mating male connector (M) in a connected state. The lock arm (30) is comprised of an arm (31) extending along forward and backward directions and an actuator (32) extending along a width direction. The arm (31) is resiliently deformed with a support (33) as a supporting point and has a lock (34) engageable with the male connector (M). The arm (31) is displaced in unlocking direction by pressing the actuator (32). Two couplings (35) coupled to the female housing (20) are provided at opposite sides of the actuator (32). The couplings (35) are inclined up towards a widthwise middle (32*a*) of the actuator (32).

9 Claims, 11 Drawing Sheets

CONNECTOR

BACKGROUND OF THE INVENTION

1. Field of the Invention

The invention relates to a connector with a lock arm.

2. Description of the Related Art

Japanese Unexamined Patent Publication No. H07-282883 discloses a connector that can be connected to a mating connector. The connector has a housing and a lock arm is cantilevered from the front end of the housing. The lock arm engages an engaging portion of the mating connector to hold the connectors in the connected state.

A pressing portion is provided at the rear end of the lock arm and can be pressed from above to deform the lock arm resiliently down and so that the lock arm can be disengaged from the engaging portion. There is a demand to miniaturize the connector. However, a miniaturized version of the above-described connector would have a smaller lock arm and a smaller pressing portion. The smaller pressing portion is more difficult to press. A wider pressing portion would address this problem. However, an external wire or the like could catch a wider pressing portion. As a result, the lock arm may undergo a deformation and may be turned up by the wire or the like.

The invention was developed in view of the above problem and an object thereof is to provide a connector suitable for miniaturization.

SUMMARY OF THE INVENTION

The invention is directed to a connector with a housing that has a lock arm for holding a mating connector in a connected state. The lock arm has an arm that extends substantially along forward and backward directions. The arm is resiliently deformable about a support and has an actuator spaced from the support. A lock is formed on the arm between the support and the actuator and is engageable with the mating connector. The actuator is wider than the arm and can be pressed to displace the arm in an unlocking direction. The extension of the actuator along the width direction ensures a sufficient operable area even if the connector is small.

The lock on the arm engages the mating connector to hold the mating connector in the connected state. However, the housing can be separated from the mating connector by pressing the actuator. As a result, the arm deforms resiliently and displaced in an unlocking direction to disengage the lock from the mating connector.

Couplings are provided at the opposite ends of the actuator and are coupled to the housing. Accordingly, the arm cannot be turned up and deformed even if an external wire or the like catches the actuator.

The operation force necessary for the pressing operation may be high because the couplings are coupled to the housing. However, the couplings incline up towards the widthwise middle. As a result, the arm can deform more easily as compared to a case where the couplings are continuous and parallel with the actuator. Therefore, the connector is suitable for miniaturization.

Two protrusions preferably are provided on outer surfaces of the housing and the couplings preferably are coupled to side surfaces of the protrusions. The actuator is resiliently deformable with base ends of the couplings as supports. The supports are higher than if the coupling were joined directly to the housing. Thus, the couplings deform more easily as compared, for example, to a case where the couplings are coupled directly to the outer surface of the housing. Accordingly, the actuator can deform the arm and the couplings relatively easily.

The protrusions preferably reach a position substantially at the same height as or higher than the actuator. The actuator is protected by both protrusions.

The actuator preferably extends in a width direction over more than about half of the housing, and preferably more than about two-thirds of the width of the housing.

The couplings preferably are inclined with respect to the widthwise middle of the housing at an angle of between about 10 and 45 degrees, and preferably about 15 and 35 degrees.

The housing comprises at least one cavity for receiving at least one terminal fitting. A lock is formed in a surrounding wall of the cavity, and is resiliently deformable to engage the terminal fitting and to retain the terminal fitting in the cavity. The lock projects out beyond the outer surface of the housing in the deformed state of the lock to prevent the housing from being connected with the mating housing when the lock is in the deformed state.

A recess preferably is formed in an outer surface of the housing between two cavities, and the lock arm preferably is in the recess.

Ribs may be formed nonsymmetrically on the outer surface of the housing to prevent the housings from being connected in an improper orientation.

DETAILED DESCRIPTION OF THE PREFERRED EMBODIMENTS

A connector according to a first embodiment of the invention is described with reference to FIGS. 1 to 10. In this embodiment, a female connector F is connectable with a mating male connector M. In the following description, ends of the two connectors F, M that are to be connected are referred to as the fronts and reference is made to all the figures except FIGS. 4 and 5 concerning the vertical direction.

Figure 1:
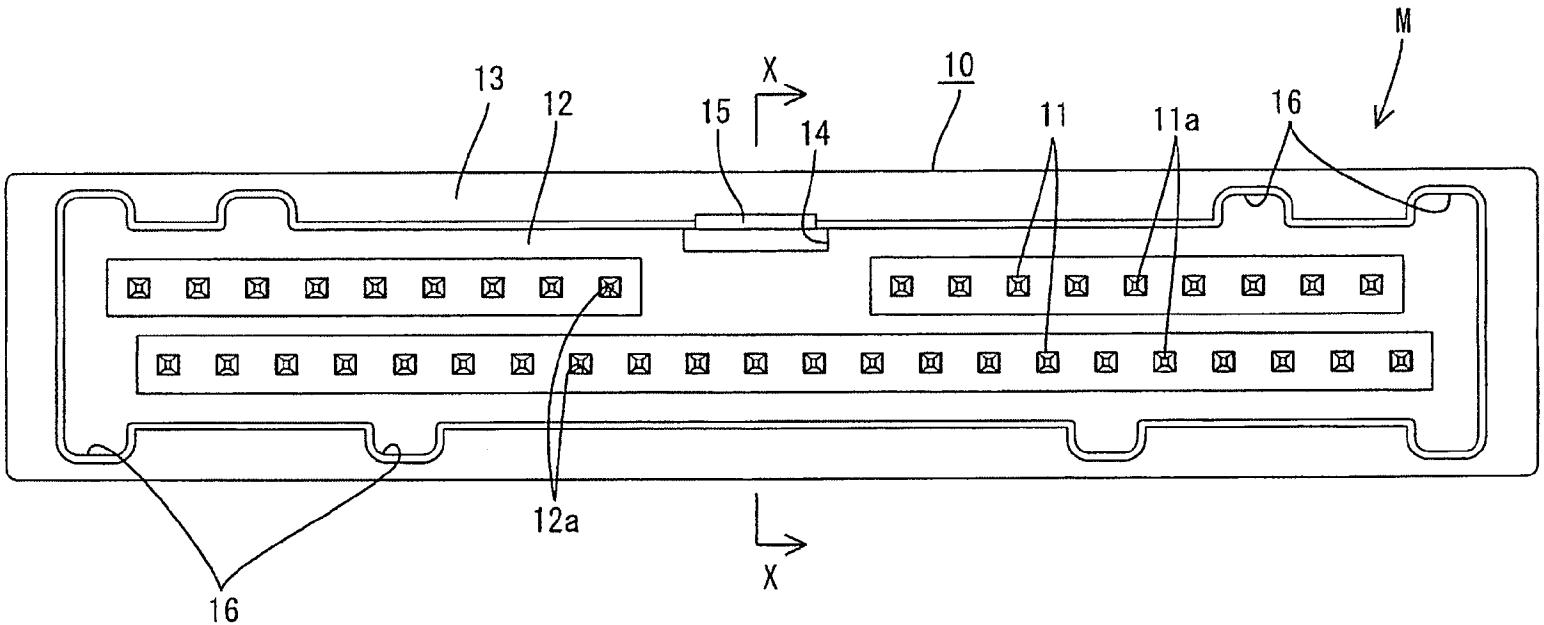
FIG. 1 is a front view of a male connector according to one embodiment of the invention.
Figure 2:
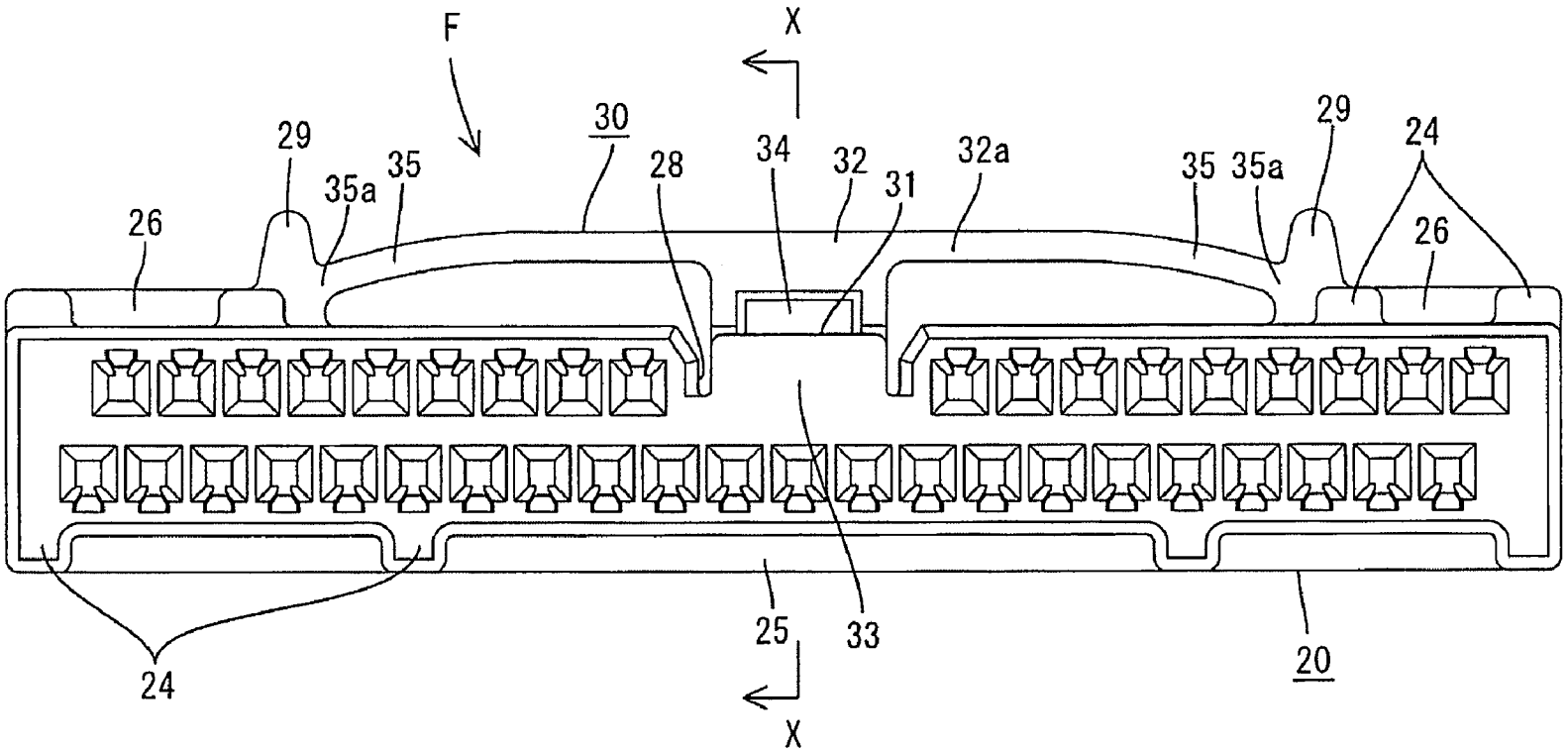
FIG. 2 is a front view of a female connector.
Figure 3:
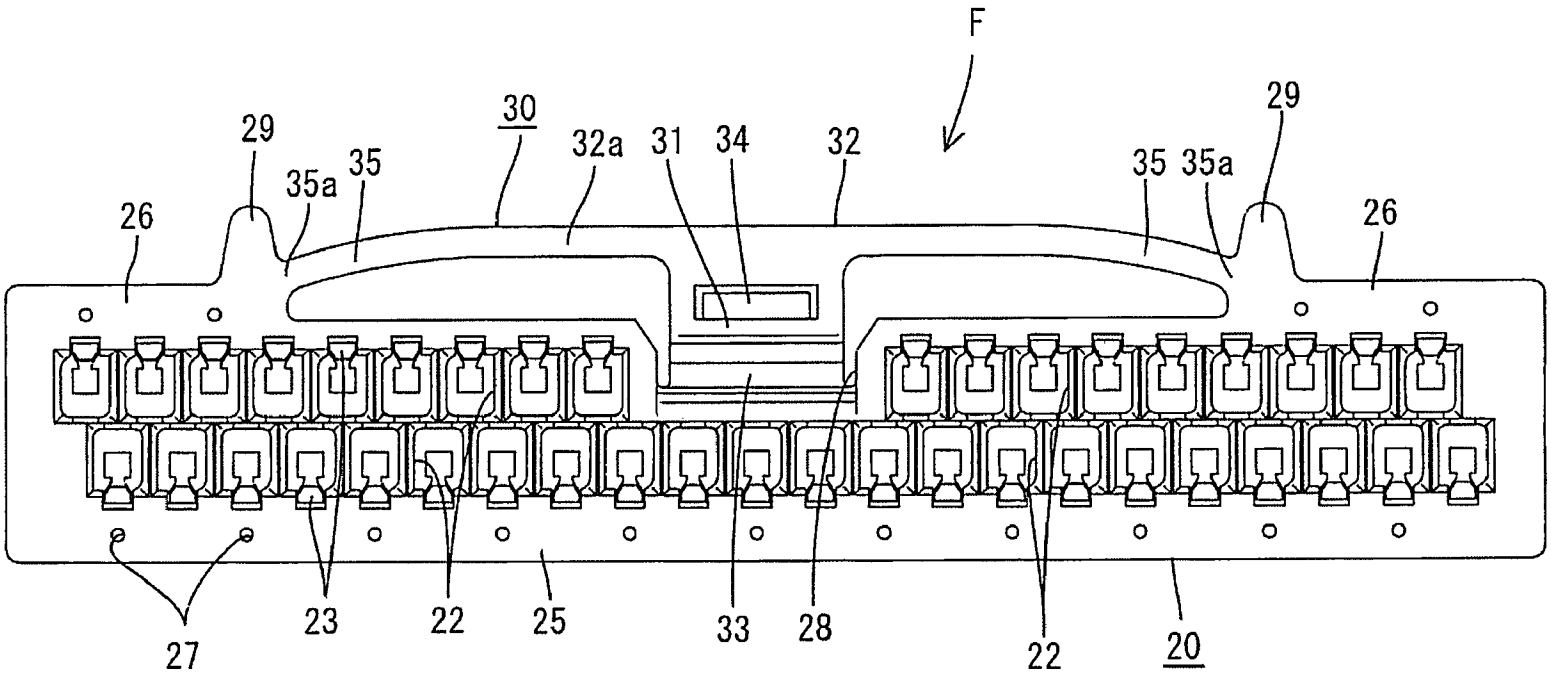
FIG. 3 is a rear view of the female connector.
Figure 4:
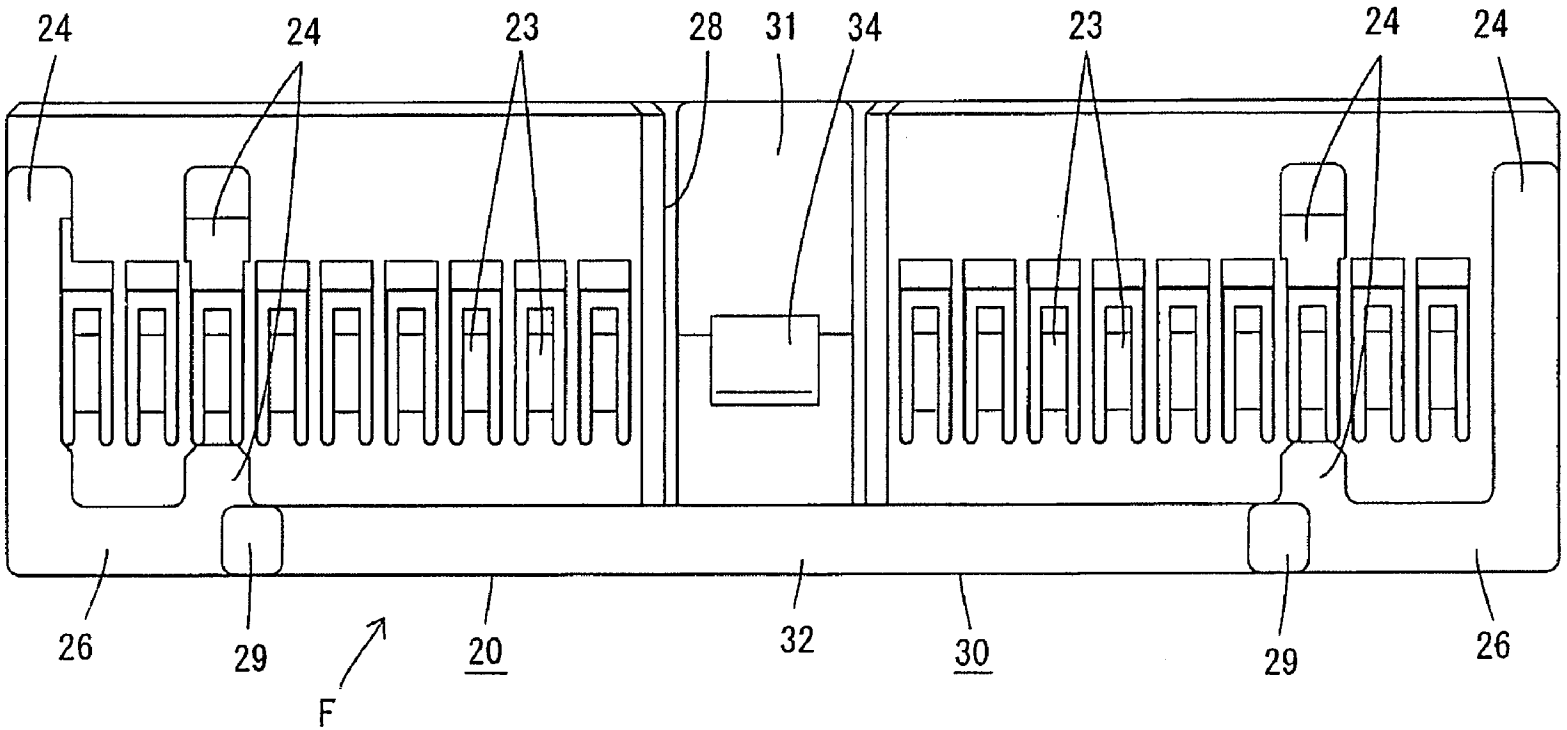
FIG. 4 is a plan view of the female connector.
Figure 5:
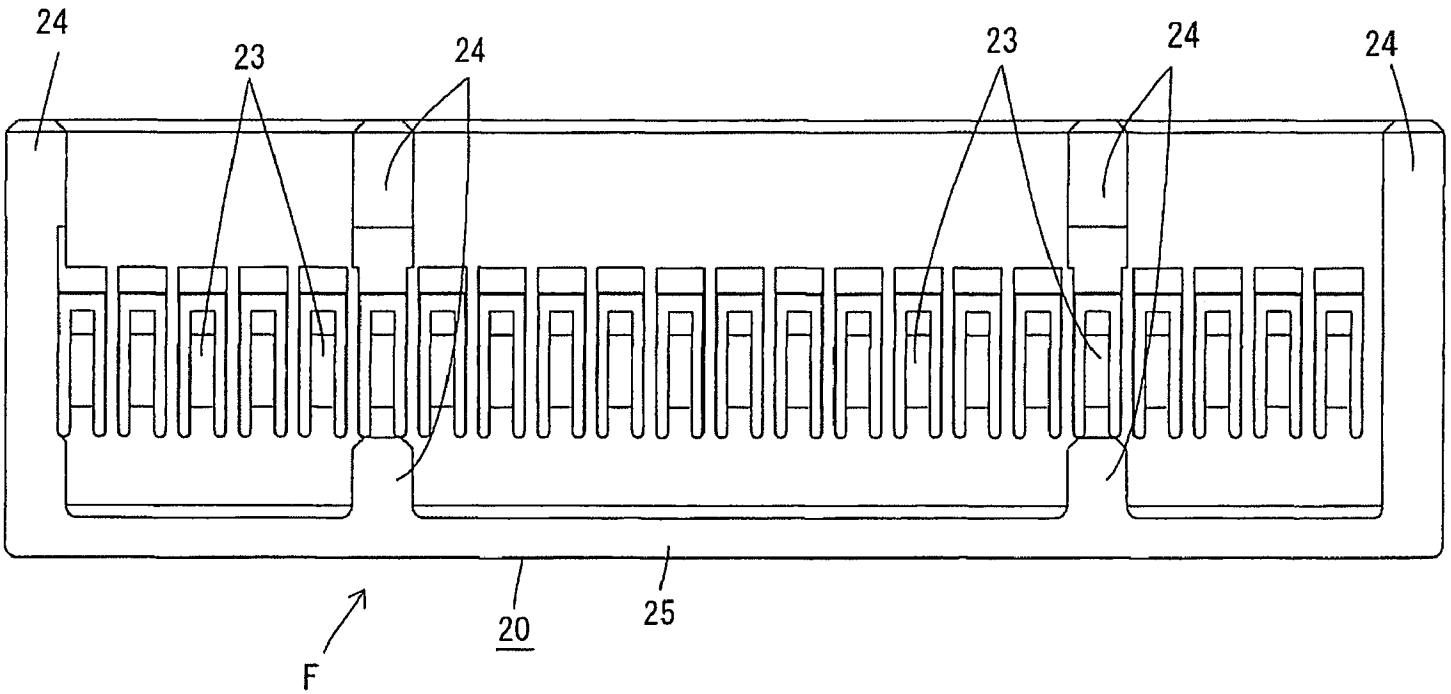
FIG. 5 is a bottom view of the female connector.
Figure 6:
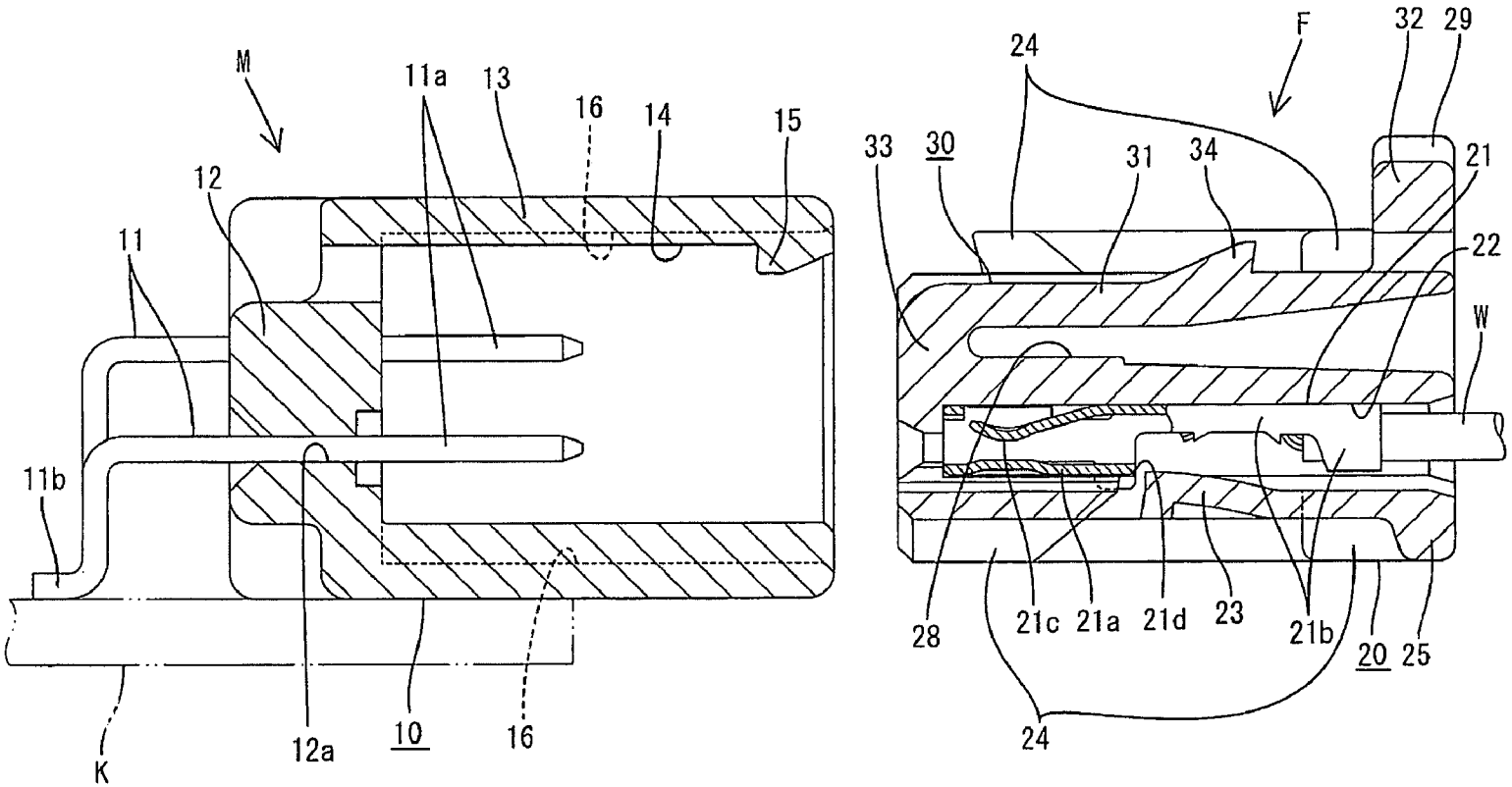
FIG. 6 is a section along 6—6 of FIGS. 1 and 2 showing a state before the two connectors are connected.

The male connector M is a circuit board connector that can be mounted on a circuit board K, as shown in FIG. 6. The male connector M has a male housing 10 made of a synthetic resin and forty male terminal fittings 11 are mounted in the male housing 10. The male housing 10 includes a terminal holding portion 12 formed with terminal insertion holes 12*a* and the male terminal fittings 11 are insertable from behind into the terminal insertion holes 12*a*. A rectangular tubular receptacle 13 projects forward from the peripheral edge of the terminal holding portion 12. The terminal insertion holes 12*a* are arranged side by side along widthwise direction at upper and lower stages. More specifically, twenty two terminal insertion holes 12*a* are arranged at the lower stage, and eighteen terminal insertion holes 12*a* are arranged at the upper stage. The eighteen terminal insertion holes 12*a* in the upper stage are arranged as two groups of nine terminal insertion holes 12*a* at each of the left and right sides, as shown in FIG. 1. Further, the terminal insertion holes 12*a* at the upper stage are displaced along the width direction from the terminal insertion holes 12*a* at the lower stage. A part of each terminal fitting that projects back from the terminal holding portion 12 is bent down at a substantially right angle and then a board connecting portion 11*b* is bent substantially at a right angle again to extend back. A connecting portion 11*a* is at the front end of the male terminal fitting 11 and projects into the receptacle 13. The board connecting portion 11*b* is connected electrically by welding or soldering with a conductor path (not shown) printed on the circuit board K.

An escaping groove 14 is formed at a widthwise middle of the upper part of the receptacle 13 and has an open rear end. An engaging portion 15 projects down at the front end of the escaping groove 14. The rear surface of the engaging portion 15 extends substantially vertically. However, the front surface of the engaging portion 15 is sloped up towards the front. Four rib receiving recesses are formed at each of the inner upper and lower surfaces of the receptacle 13. The male housing 10 can be fixed to the circuit board K using an unillustrated mounting member.

The female connector F has a female housing 20 made of a synthetic resin and forty female terminal fittings 21 are accommodated in the female housing 20, as shown in FIGS. 2 to 6. More particularly, cavities 22 are arranged side-by-side at positions corresponding to the respective terminal insertion holes 12*a* of the male connector M. Specifically, twenty two cavities 22 are arranged at the lower stage and eighteen cavities 22 are arranged at the upper stage in the female housing 20. The eighteen upper stage cavities 22 are arranged so that nine cavities 22 are at each of left and right sides. Further, the cavities 22 at the upper stage are displaced from the cavities 22 at the lower stage along the width direction. The female terminal fittings 21 are insertable into the cavities 22 from behind. Each female terminal fitting 21 has a main portion 21*a* and a barrel 21*b* coupled one after the other. The main portion 21*a* is a box that is substantially hollow along forward and backward directions. The barrel 21*b* is crimped into connection with an end of a wire W. A resilient contact piece 21*c* is provided in the main portion 21*a* for resiliently contacting the connecting portion 11*a* of the male terminal fitting 11.

A cantilever-shaped lock 23 is formed in a surrounding wall of each cavity 22 by forming slits in the upper wall of each cavity 22 at the upper stage or in the bottom wall of each cavity at the lower stage. The lock 23 is resiliently deformable along the vertical direction and is engageable with a jaw 21*d* of the main portion 21*a* of the female terminal fitting 21 to retain the female terminal fitting 21 in the cavity 22. Each lock 23 is inclined to bulge out into the cavity 22 from the rear end thereof towards the free front end. The outer surface of each lock 23 is continuous with the outer surface of the female housing 20 and is exposed to the outside. The lock 23 projects more outward than the outer surface of the female housing 20 in its resiliently deformed state. Thus, if an attempt is made to connect the housings 10, 20 in this state, this outward projecting part of the lock 23 interferes with the front end surface of the receptacle 13 to hinder the connecting operation.

Ribs 24 are provided on the upper and bottom surfaces of the female housing 20 to guide the connecting operation of the two housings 10, 20. More specifically, eight ribs 24 are provided at the opposite widthwise ends and two specified positions displaced towards the center from the opposite widthwise ends of each of the upper and lower surfaces. The ribs 24 extend forward from the rear end of the female housing 20. However, intermediate portions of the ribs 24 displaced towards the widthwise center are removed because the locks 23 are exposed at the upper and lows surfaces of the female housing 20 (see FIGS. 4 and 5). Thus, the ribs 24 towards the widthwise center are divided into front and rear sections. The upper stage ribs 24 towards the widthwise center are displaced along the width direction from the lower stage ribs 24 displaced towards the widthwise center. The front ends of the lower ribs 24 substantially align with the front end of the female housing 20, whereas the front ends of the upper ribs 24 are retracted from the front end of the female housing 20 and the front end surfaces thereof overhang towards the front. The rear ends of the lower ribs 24 are coupled to each other by a finger placing portion 25 that extends along the width direction. The finger placing portion 25 has the same height as the ribs 24 and is formed so that an operator can place his fingers thereon while connecting and separating the female housing 20. The finger placing portion 25 is formed over the entire width of the female housing 20 and is coupled to the ribs 24 at the opposite ends. Thus, the finger placing portion 25 contributes to the strength of the female housing 20 (see FIG. 5). The two upper ribs 24 adjacent each end have their rear ends joined by a coupling 26 (see FIG. 4). Marks 27 are formed by recessing in the rear end surfaces of the ribs 24, the finger placing portion 25 and the couplings 26 for letting the operator visually confirm the positions of the cavities 22 (see FIG. 3). It should be noted that the intervals and shape of the marks 27 can be changed from those shown.

A recess 28 is formed at the widthwise middle of the upper surface of the female housing 20 and extends the entire length of the female housing 20. The recess 28 has a depth corresponding to the depths of the cavities 22 at the upper stage. A lock arm 30 projects in the recess 28. The lock arm 30 includes an arm 31 and an actuator 32 that are coupled to one another. The arm 31 extends forward and backward and the actuator 32 extends along the width direction. The arm 31 has a support 33 coupled to the front end of the bottom surface of the recess 28, and the arm 31 is resiliently deformable vertically about the support 33 (see FIG. 7). The upper surface of the arm 31 is substantially at the same height as the upper surface of the female housing 20. Thus, the arm 31 is at substantially the same height as the cavities 22 at the upper stage. A lock 34 projects up at a substantially longitudinal middle of the upper surface of the arm 31 (see FIG. 8) and is engageable with the engaging portion 15 of the male connector M. Front and rear end surfaces of the lock 34 extend along the front and rear end surfaces of the engaging portion 15. Thus, the front surface of the lock 34 slopes up towards the back and the rear surface thereof is a substantially straight vertical surface. The length of the arm 31 substantially equals the length of the female housing 20, and the actuator 32 is coupled to the free rear end thereof.

The substantially widthwise middle of the lower surface of the actuator 32 is coupled to the upper surface of the rear end of the arm 31. Accordingly, the arm 31 can be deformed resiliently down in the unlocking direction by pressing the actuator 32. The actuator 32 is wider than the arm 31. Couplings 35 are provided at the opposite ends of the actuator 32 and are coupled to the female housing 20. Accordingly, the lock arm 30 will not turn up and deform even if an external wire or the like gets caught by the pressing portion 32. More specifically, two protrusions 29 project up from the upper surface of the female housing 20, and the couplings 35 of the actuator 32 are coupled to inward-facing side surfaces of the protrusions 29. The couplings 35 are inclined up toward a widthwise middle 32*a* of the actuator 32 to define an arch shape for the actuator 32. The widthwise middle 32*a* of the actuator 32 is substantially horizontal, whereas both couplings 35 have a substantially arcuate shape. The height of the protrusions 29 from the upper surface of the female housing 20 is higher than the highest position of the actuator 32. Thus, the protrusions 29 protect the actuator 32. Each protrusion 29 is narrowed gradually from the base toward the projecting end. The couplings 35 are coupled to the inward-facing side surfaces of the protrusions 29 at substantially middle positions along the height, and hence above the upper surface of the female housing 20. Thus, the actuator 32 is resiliently deformable up and down with coupling base ends 35*a* as supports (see FIG. 10). In this way, the lock arm 30 is supported at three points.

The female connector F is connected with the male connector M mounted on the circuit board K. An attempt could be made to connect the female housing 20 with the male housing 10 while holding the female housing 20 vertically inverted from its proper posture. However, the front ends of the ribs 24 will contact the front end of the receptacle 13 to hinder the connecting operation. As a result, an erroneous connection can be prevented.

Figure 7:
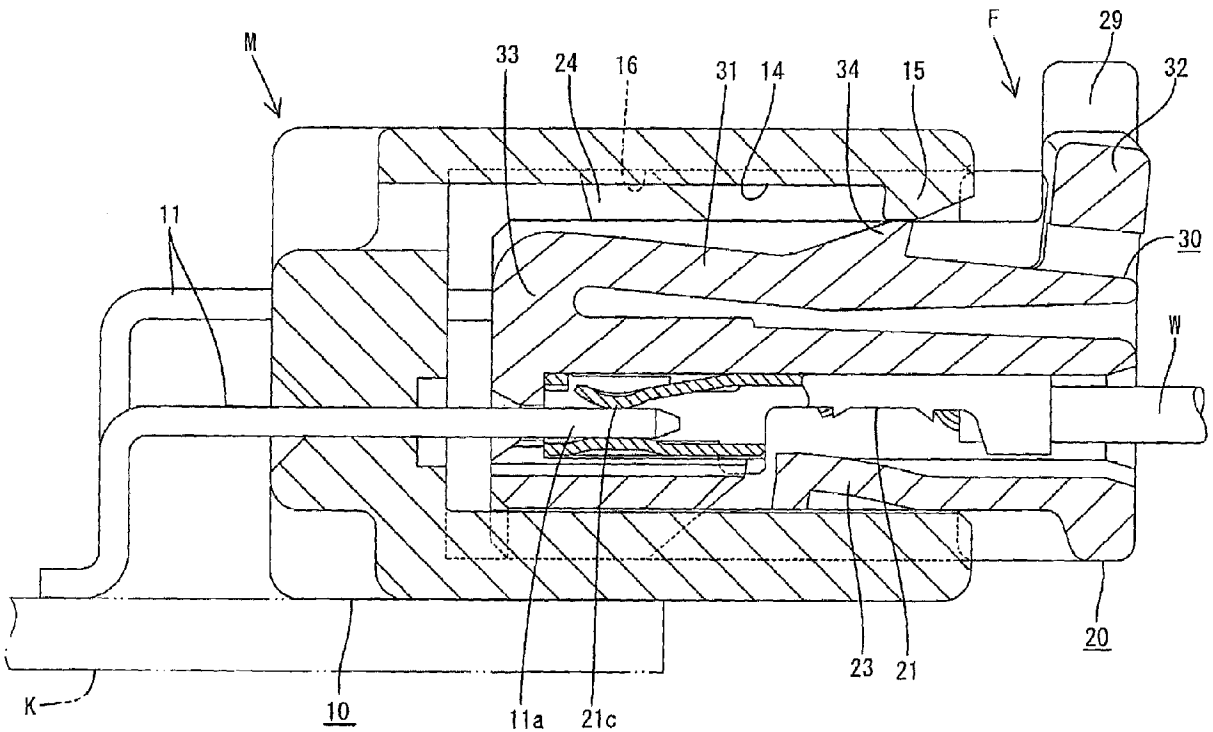
FIG. 7 is a section similar to FIG. 6, but showing an intermediate stage of the connection of the two connectors.
Figure 8:
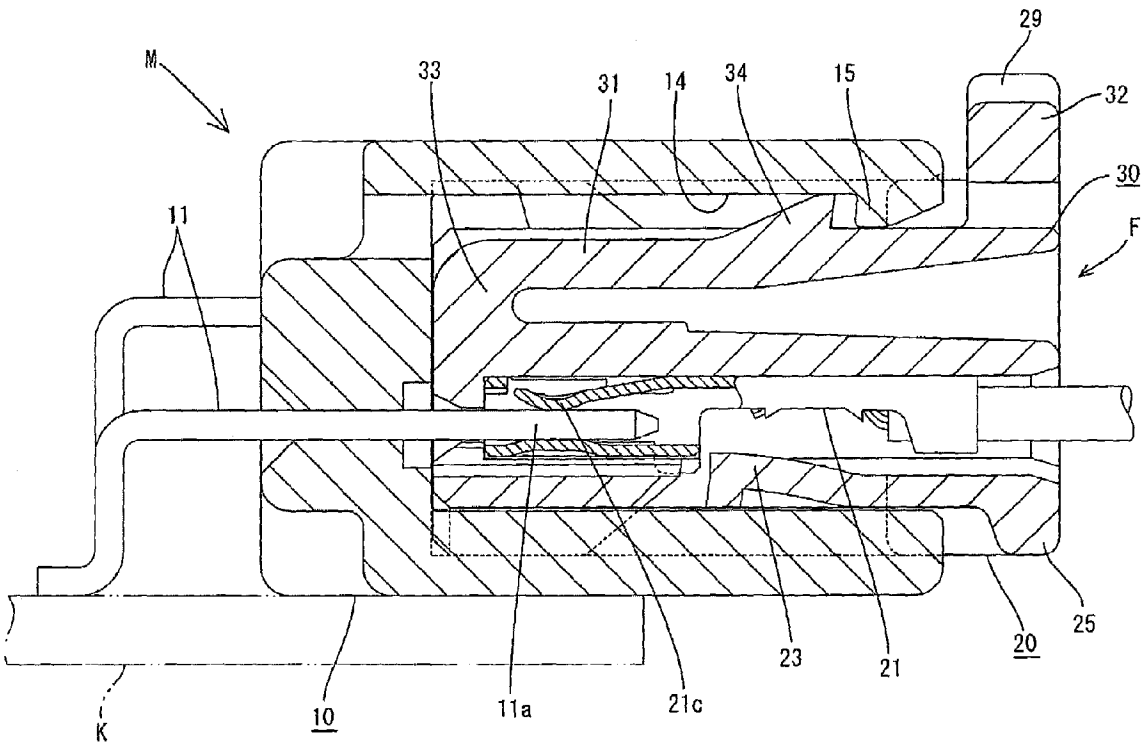
FIG. 8 is a section similar to FIGS. 6 and 7, but showing a state where the two connectors are properly connected.

The ribs 24 enter the corresponding rib receiving recesses 16 and guide the connecting operation smoothly when the properly held female housing 20 is fit into the receptacle 13 of the male housing 10, as shown in FIG. 6. The slanted front surface of the lock 34 slides in contact with the slanted front surface of the engaging portion 15 when the female housing 20 is connected to a specified depth. As a result, the lock arm 30 is deformed resiliently in the deforming direction DD, as shown in FIG. 7. More particularly, the arm 31 is displaced down about the support 33, and the actuator 32 is displaced down with the coupling base ends 35*a* of both couplings 35 as supports. The lock 34 reaches the escaping groove 14 when the female housing 20 is connected to a proper depth. As a result, the lock arm 30 is restored resiliently and the rear surface of the lock 34 engages the rear of the engaging portion 15 as shown in FIG. 8. In this way, the two connectors F, M are held in their connected state. At this time, the resilient contact pieces 21*c* of the female terminal fittings 21 are held in contact with the connecting portions 11*a* of the male terminal fittings 11.

Figure 9:
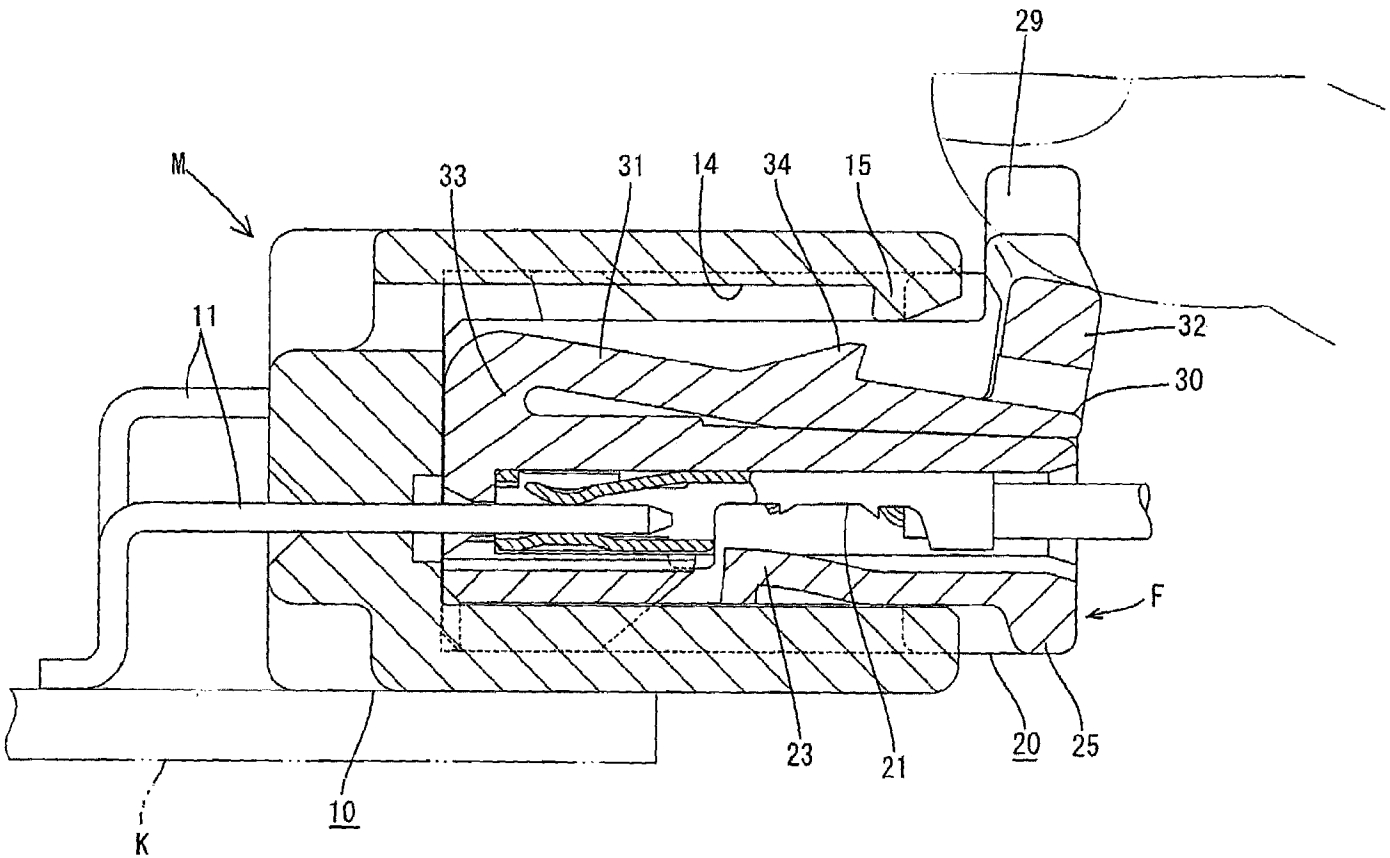
FIG. 9 is a section similar to FIGS. 6–8, but showing a state where a pressing portion is pressed at the time of separating the two connectors.
Figure 10:
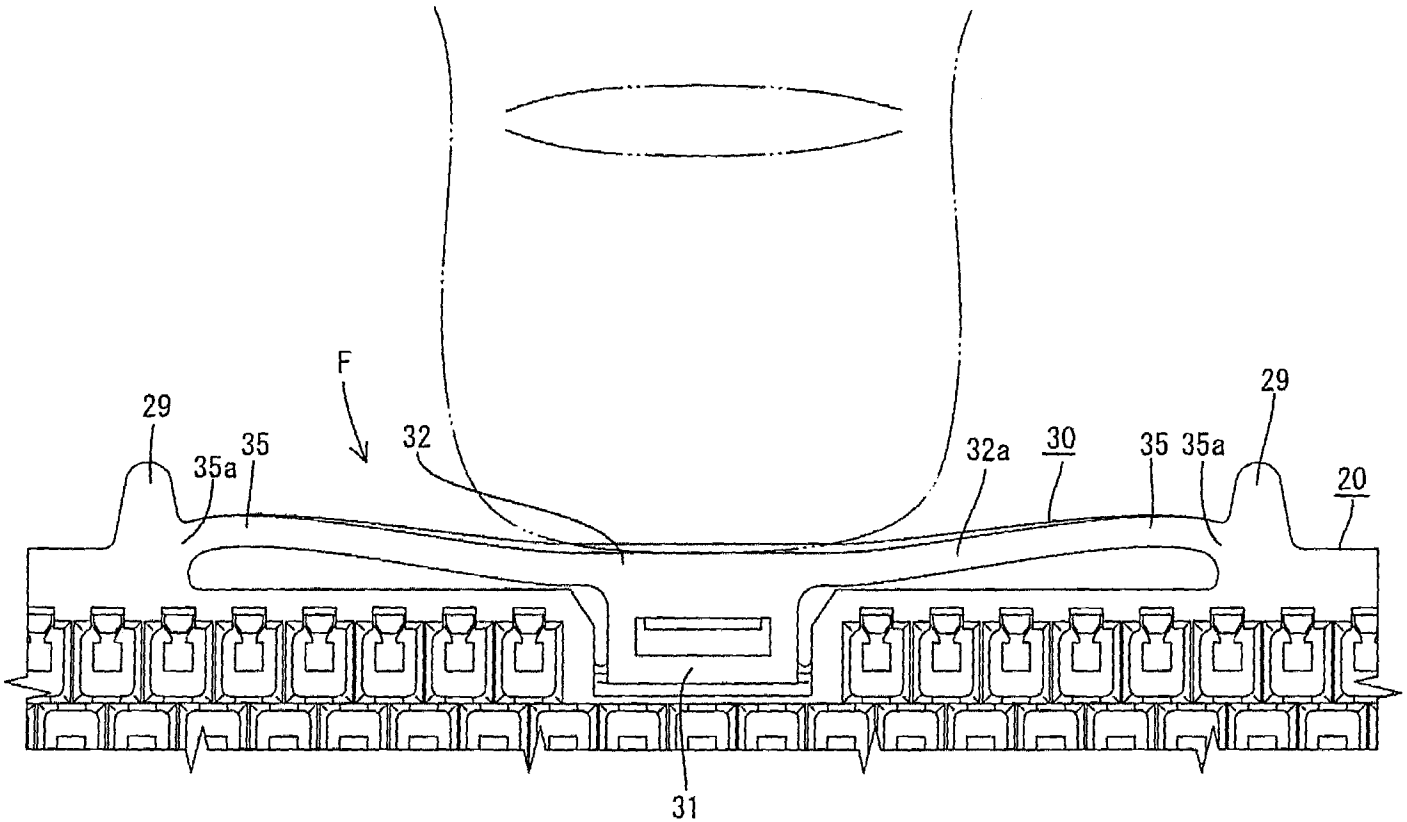
FIG. 10 is an enlarged rear view showing the state where the pressing portion is pressed at the time of separating the two connectors.

The connectors M, F may have to be separated for maintenance. In such a case, the actuator 32 is pressed from above by fingers to deform the lock arm 30. The arm 31 then is displaced down about the support 33, as shown in FIG. 9, and the actuator 32 is displaced down with the base ends 35*a* of both couplings 35 as supports. Thus, the lock 34 is displaced down from the escaping groove 14 to gradually reduce an area of engagement with the engaging portion 15 as shown in FIG. 10. The female housing 20 is pulled back while keeping the actuator 32 pressed and soon reaches a position where the lock 34 disengages completely from the engaging portion 15. Thus, the female connector F can be separated from the male connector M. The actuator 32 may be pressed sufficiently for the widthwise middle 32*a* to be lower than the coupling base ends 35*a* (see FIG. 10). Fingers then can be placed on the finger placing portion 25 so that the female connector F can be pulled easily.

The actuator 32 extends along the width direction WD to ensure a sufficient pressable area. Accordingly, pressing is performed easily. The couplings 35 at the opposite ends of the actuator 32 could be coupled to the female housing 20, and in this situation, a larger force would be necessary for the pressing operation. However, the couplings 35 are inclined up towards the widthwise middle 32*a* at an angle of between about 10 and 45 degrees and preferably between about 15 and 35 degrees. Thus, the actuator 32 can be deformed more easily than a case where the couplings are parallel with the widthwise middle. Thus, pressing ease is reduced only to a slight extent. In addition, both couplings 35 of the actuator 32 are coupled to the side surfaces of the protrusions 29 at intermediate height positions, and the actuator 32 is deformed resiliently with the coupling base ends 35*a* as supports. Thus, the supports are higher at the time of the resilient deformation and the actuator 32 can deform relatively easily as compared to a case where the couplings are coupled directly to the outer surface of the female housing.

The invention is not limited to the above described and illustrated embodiment. For example, the following embodiments are also embraced by the technical scope of the present invention as defined by the claims. Beside the following embodiment, various changes can be made without departing from the scope and spirit of the present invention as defined by the claims.

Figure 11:
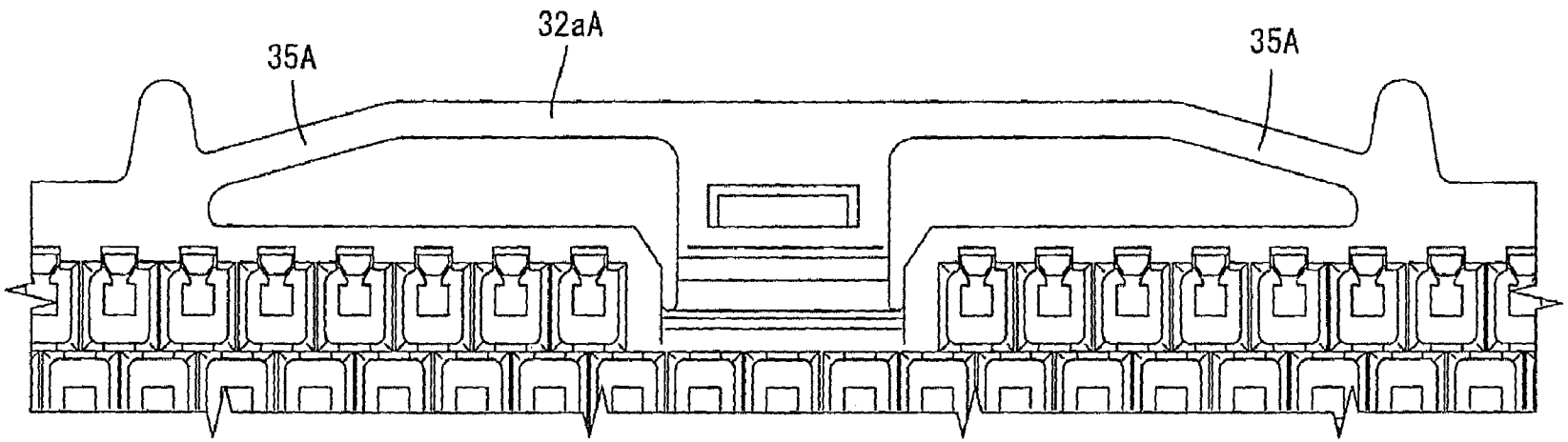
FIG. 11 is an enlarged rear view of a female connector according to another embodiment.

The mode of the pressing portion can be changed. Specifically, as shown in FIG. 11, couplings 35A are coupled to a widthwise middle portion 32*a*A and extend obliquely and straight instead of being arcuate. As another mode, the widthwise middle may have a shape other than the horizontal shape. As another mode, the entire pressing portion may, for example, extend slightly oblique to widthwise direction.

The mode of the arm can also be changed. For example, the arm may extend slightly oblique to forward and backward directions or may be seesaw-shaped by having the support coupled to a position other than the front end of the arm.

Although the arm and the pressing portion are coupled to each other in the foregoing embodiment, they may be separate from each other according to the present invention. Further, the protrusions may have substantially the same height as or may be lower than the actuator or may be omitted according to the present invention.

The male connector is fixed to the circuit board in the foregoing embodiment. However, the male connector may be provided at ends of wires.

The female connector has the lock arm in the foregoing embodiment. However, the male connector may be provided with the lock arm according to the invention. Further, the number and arrangement of the respective terminal fittings can be changed.

What is claimed is:

1. A connector having a housing with opposite front and rear ends defining forward and backward directions and opposite sides defining a width direction, a lock arm for holding a mating connector in a connected state, the lock arm comprising an arm joined to the housing at a support and extending from the support substantially along the forward and backward directions, a lock formed on the arm and configured for engagement with the mating connector, an actuator joined to the arm and extending substantially along the width direction, the arm being resiliently deformable about the support in an unlocking direction in response to pressing forces on the actuator, and two couplings coupled to the housing at opposite sides of the actuator and inclined up towards a widthwise middle of the actuator, wherein two protrusions are provided on an outer surface of the housing, the couplings being coupled to side surfaces of the protrusions, and the actuator being resiliently deformable with coupling base ends of the couplings as supports.

2. The connector of claim 1, wherein both protrusions are formed to reach a position at least as high as the actuator.

3. The connector of claim 1, wherein the actuator extends substantially along the widthwise direction over more than about half of the width of the housing.

4. The connector of claim 1, wherein the couplings are inclined towards a widthwise middle by an angle between about 10° and 45°.

5. The connector of claim 1, wherein the housing comprises cavities arranged on at least one stage for receiving terminal fittings, wherein a lock is formed in a surrounding wall of the cavity and is resiliently deformable to be engageable with the terminal fitting to retain the terminal fitting in the cavity.

6. The connector of claim 5, wherein the lock projects more outward than the outer surface of the housing in its resiliently deformed state, so that if an attempt is made to connect the housing with the mating housing in this state, this outward projecting part of the lock interferes with the mating housing to hinder the connecting operation.

7. The connector of claim 6, wherein a recess having a depth substantially corresponding to the cavities is formed over substantially the entire length at a substantially widthwise middle position of the outer surface of the housing, and the lock arm projects there.

8. The connector of claim 1, wherein ribs are provided on the housing in an asymmetric way to hinder the connection of the housing being improperly oriented with the mating housing.

9. A connector having a housing with opposite front and rear ends and a plurality of surrounding walls extending in forward and backward directions between the front and rear ends, cavities extending through the housing between the front and rear ends for receiving terminal fittings, resiliently deflectable locks formed in the surrounding walls and projecting at least partly into the respective cavities, the locks deflecting outwardly from the surrounding walls during insertion of the terminal fittings into the respective cavities and returning resiliently into alignment with the surrounding walls for engaging the terminal fitting that has been inserted completely into the respective cavity, whereby an outward projecting part of the lock interferes with the mating housing to hinder a connecting operation if any one of the terminal fittings is not inserted completely, wherein two protrusions are provided on an outer surface of the housing, the couplings being coupled to side surfaces of the protrusions, and the actuator being resiliently deformable with coupling base ends of the couplings as supports.

* * * * *